US005777658A

United States Patent [19]

Kerr et al.

[11] Patent Number: 5,777,658

[45] Date of Patent: Jul. 7, 1998

[54] MEDIA LOADING AND UNLOADING ONTO A VACUUM DRUM USING LIFT FINS

[75] Inventors: Roger Stanley Kerr, Brockport; Douglas Alvin Hons, Rochester, both of N.Y.

[73] Assignee: Eastman Kodak Company, Rochester, N.Y.

[21] Appl. No.: 612,732

[22] Filed: Mar. 8, 1996

[51] Int. Cl.[6] ..... B41J 17/00

[52] U.S. Cl. ..... 347/215

[58] Field of Search ..... 347/134, 215, 347/216, 217, 264; 346/134, 138

[56] References Cited

U.S. PATENT DOCUMENTS

| | | | |
|---|---|---|---|
| 746,124 | 12/1903 | Mosher . | |
| 4,517,575 | 5/1985 | Kakimoto et al. . | |
| 4,772,582 | 9/1988 | DeBoer . | |
| 5,086,318 | 2/1992 | Takeda et al. . | |
| 5,130,758 | 7/1992 | Takeda et al. . | |
| 5,138,497 | 8/1992 | Blanding . | |
| 5,142,305 | 8/1992 | Maslanka et al. . | |
| 5,260,714 | 11/1993 | DeCook et al. | 347/264 |
| 5,276,464 | 1/1994 | Kerr et al. . | |
| 5,344,519 | 9/1994 | Galchefski et al. | 156/456 |
| 5,436,695 | 7/1995 | Lucking et al. | 347/264 X |
| 5,446,477 | 8/1995 | Baek et al. | 347/215 X |
| 5,576,754 | 11/1996 | Korem | 347/262 |

*Primary Examiner*—Edward Tso
*Attorney, Agent, or Firm*—Nelson Adrian Blish

[57] ABSTRACT

Apparatus for superposing a receiver sheet and a donor sheet on an imaging drum communicates vacuum from the interior of the drum to the exterior surface. A leading edge of a receiver sheet is advanced into alignment with a predetermined position on the drum surface while being held radially off of the drum surface. The drum is rotated to thereby draw the receiver sheet into contact with the drum surface. Next, a leading edge of a donor sheet is advanced into alignment with a predetermined position on the drum surface while being held radially off of the drum surface. The drum is again rotated to thereby draw the donor sheet into contact with the drum surface. The leading edge of the receiver sheet and the donor sheet are held radially off of the drum surface until aligned with the predetermined position, and thereupon is lowered radially onto the drum surface.

14 Claims, 14 Drawing Sheets

FIG. 5
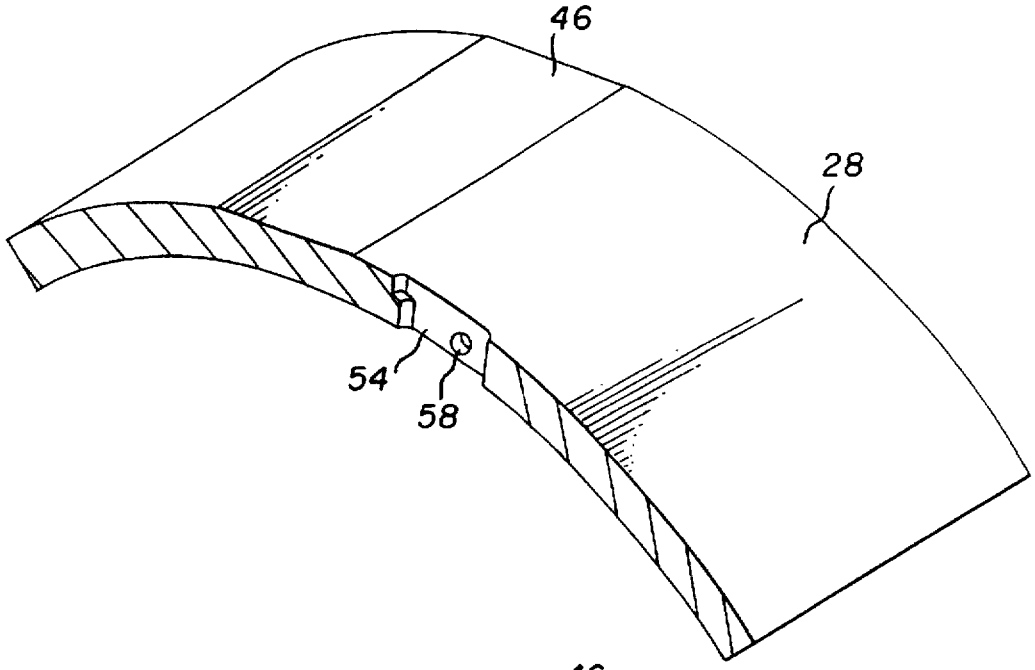
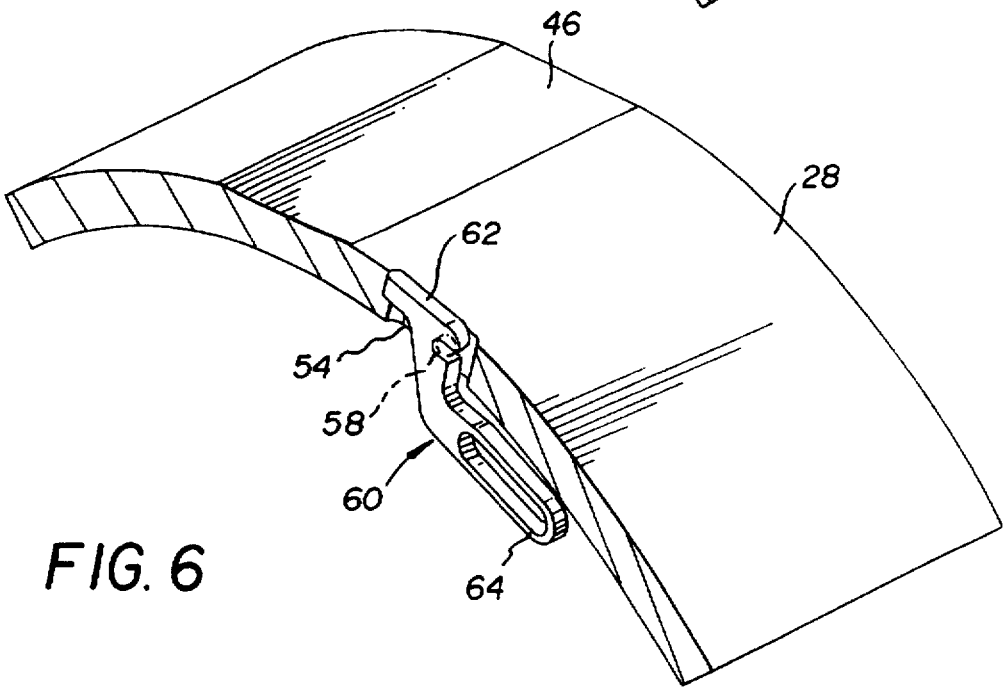
FIG. 6

MEDIA LOADING AND UNLOADING ONTO A VACUUM DRUM USING LIFT FINS

BACKGROUND OF THE INVENTION

1. Technical Field

This invention relates to a subsystem for loading and unloading sheet media onto a writing drum of imaging apparatus, and more specifically to loading and unloading sheet media onto a vacuum drum.

2. Background Art

A commercially available laser thermal printer, which is depicted in commonly assigned U.S. Pat. No. 5,276,464, employs a rotating drum to hold donor and receiver sheet media during the writing process. This media, wrapped about the drum, rotates past a writing head that moves along the drum as it writes the image.

The task of loading media onto a vacuum drum and removing media from the drum by wrapping and unwrapping the media requires precise positioning of the media. To wrap donor and receiver media onto the drum, the lead edge position of the media must be accurately controlled. The lead edge must be secured onto the drum during loading and the lead edge must be released from the drum to remove media.

Existing printer designs, such as that disclosed in said commonly assigned U.S. patent, use a multi-chambered drum for such lead-edge control. One appropriately controlled chamber applies vacuum that holds the lead edge of the receiver media. Another chamber, separately valved, controls vacuum that holds the lead edge of the donor media to the drum. With this arrangement, loading a sheet of media requires that the printer feed the lead edge of the media into position just past the vacuum ports controlled by the respective valved chamber. Then, vacuum is applied, gripping the lead edge of the media against the drum surface. Unloading the media (to discard the used donor sheet or to deliver the finished receiver sheet to an output tray) requires the removal of vacuum from these same chambers so that an edge of the media is freed and projects out from the surface of the drum. The printer then positions an articulating skive into the path of the free edge to lift this edge further and to feed the media to an output tray.

Although the existing design works well for its intended purpose, the components used for lead edge control affect the drum's shape when rotating. To understand this problem, consider the critical dimension that must be maintained during the writing process. The laser thermal printing process requires extremely precise laser focus; holding the distance between the lens and writing surface to within a few microns. To maintain proper focus, printer design must compensate for media tolerances, runout, drum-to-translator misalignment, and other possible sources of error.

A critical factor of focus irregularity can be the writing drum itself. With existing drum arrangements, such as the above-described multi-chambered vacuum imaging drum, internal drum components can cause the drum to go out-of-round at high rotational speeds. With such a design, the mass of internal valve chambers, body valves, and balance bar cannot be uniformly distributed. When rotating at speeds above 1000 RPM, the non-uniform distribution of mass for this type of drum can cause the drum to go out of round by as much as 80 microns or more, causing the drum to go out of balance.

Existing designs can compensate for small out-of-round effects. An autofocus scheme such as disclosed in commonly assigned U.S. Pat. No. 5,138,497 dynamically moves a lens assembly relative to the media surface on the drum to maintain critical optical dimensions across the full image. Autofocus devices, however, are complex and expensive. Moreover, these devices don't operate quickly enough for high rotational speeds. The autofocus approach effectively limits the possible drum rotational speed, and hence the throughput, of a printer.

Overall, the complexity, cost and throughput constraints of the multi-chambered vacuum drum design inhibit its use in faster and less expensive laser thermal printers.

DISCLOSURE OF THE INVENTION

It is an object of the present invention to provide a vacuum drum with a substantially uniform distribution of mass relative to its rotational axis, such as to experience minimal out-of-round effect and imbalance when the drum rotates at high speeds. As a result, the need for autofocus is minimized or eliminated at both conventional rotational speeds and higher-than-presently-attainable speeds.

It is another object of the present invention to provide a single-chambered vacuum drum which is of a simple design, less expensive, having a lower parts count, and easier to manufacture than prior art, multi-chambered counterparts.

According to one feature of the present invention, apparatus is provided for superposing a receiver sheet and a donor sheet on an imaging drum. Vacuum communicates from the interior of the drum to the exterior surface. A leading edge of a receiver sheet is advanced into alignment with a predetermined position on the drum surface while being held radially off of the drum surface. The drum is rotated to thereby draw the receiver sheet into contact with the drum surface. Next, a leading edge of a donor sheet is advanced into alignment with a predetermined position on the drum surface while being held radially off of the drum surface. The drum is again rotated to thereby draw the donor sheet into contact with the drum surface.

According to another feature of the present invention, the leading edge of the receiver sheet is held radially off of the drum surface until aligned with the predetermined position, and thereupon is lowered radially onto the drum surface.

According to another still feature of the present invention, the leading edge of the donor sheet is held radially off of the drum surface until aligned with the predetermined position, and thereupon is lowered radially onto the drum surface.

According to yet another feature of the present invention, the drum has a plurality of rows of vacuum ports aligned with edges of loaded receiver and donor sheets, respectively; and a single vacuum source is exposed uniformly to all ports simultaneously.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which:

FIG. 5 shows a sectioned portion of the drum of FIG. 1;

FIG. 6 shows the portion of the drum of FIG. 5 with a received lift fin;

BEST MODE FOR CARRYING OUT THE INVENTION

The present description will be directed in particular to elements forming part of, or cooperating more directly with, apparatus in accordance with the present invention. It is to be understood that elements not specifically shown or described may take various forms well known to those skilled in the art. While the invention is described below in the environment of a thermal printer, it will be noted that the invention can be used with other types of imaging apparatus.

Figure 1:
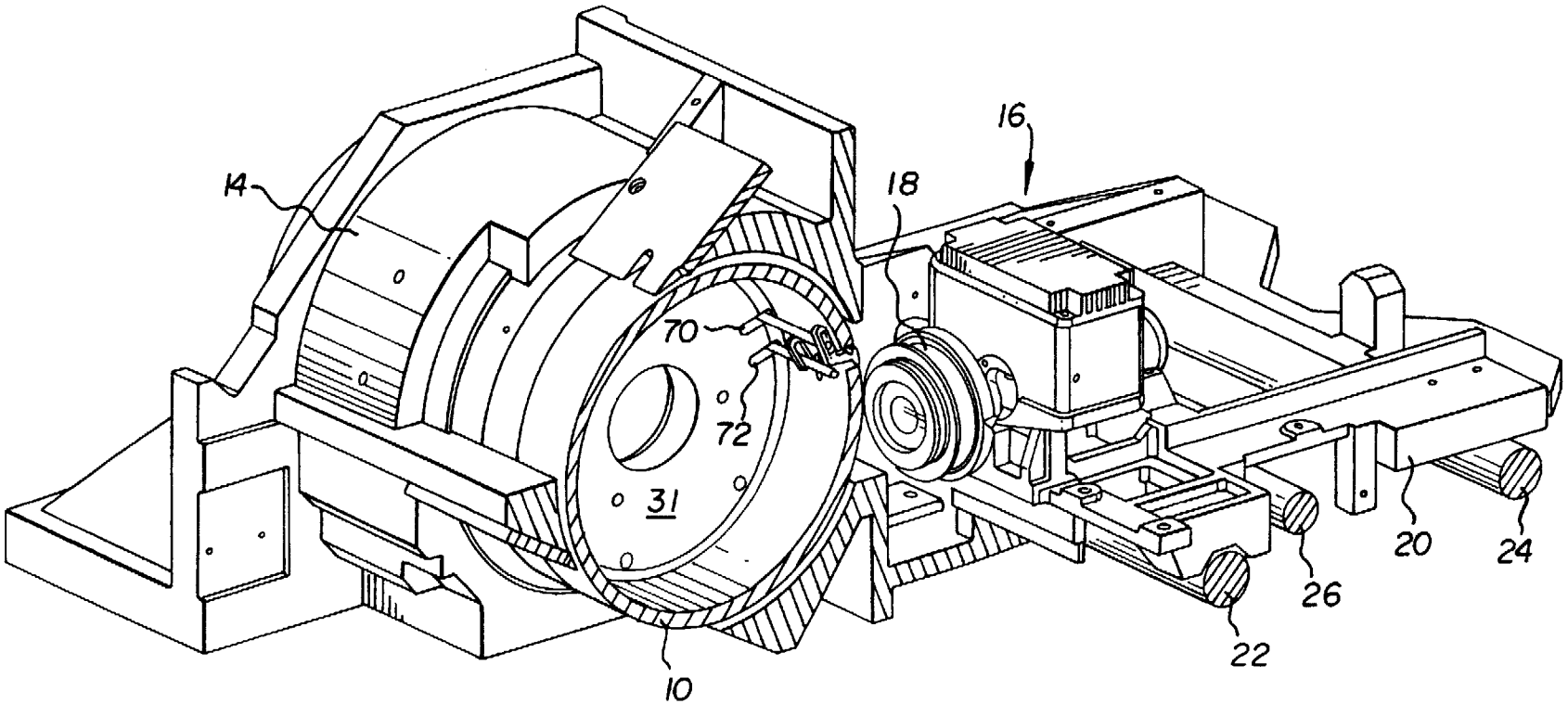
FIG. 1 is a perspective view of an imaging drum and a write head according to the present invention, partially in section to reveal hidden portions thereof.

Referring to FIG. 1, an imaging drum 10 is mounted for rotation about an axis 12 in a frame member 14. The imaging drum is adapted to support a print medium such as one wherein a dye is transferred from a donor sheet to a receiver sheet as a result of heating the dye in the donor sheet. The donor sheet and the receiver sheet are superposed in intimate contact and are held onto the peripheral surface of the drum by vacuum applied to the superposed elements from the interior of the drum. A thermal print medium for use with the printer can, for example, be the medium disclosed in commonly assigned U.S. Pat. No. 4,772,582, which includes a donor sheet which, when irradiated, converts light energy to heat energy. The dye in the immediate vicinity is heated to its vaporization temperature for transfer to the receiver sheet.

A movable writing head assembly 16 is movably supported adjacent imaging drum 10, and includes a writing head 18 which is mounted on a translator member 20 which, in turn, is slidably supported on bars 22 and 24, which are parallel to the axis of drum 10. Translator member 20 is driven by a motor, not shown, which rotates a lead screw 26 parallel to bars 22 and 24 to move writing head 18 parallel to the axis of the drum.

Figure 2:
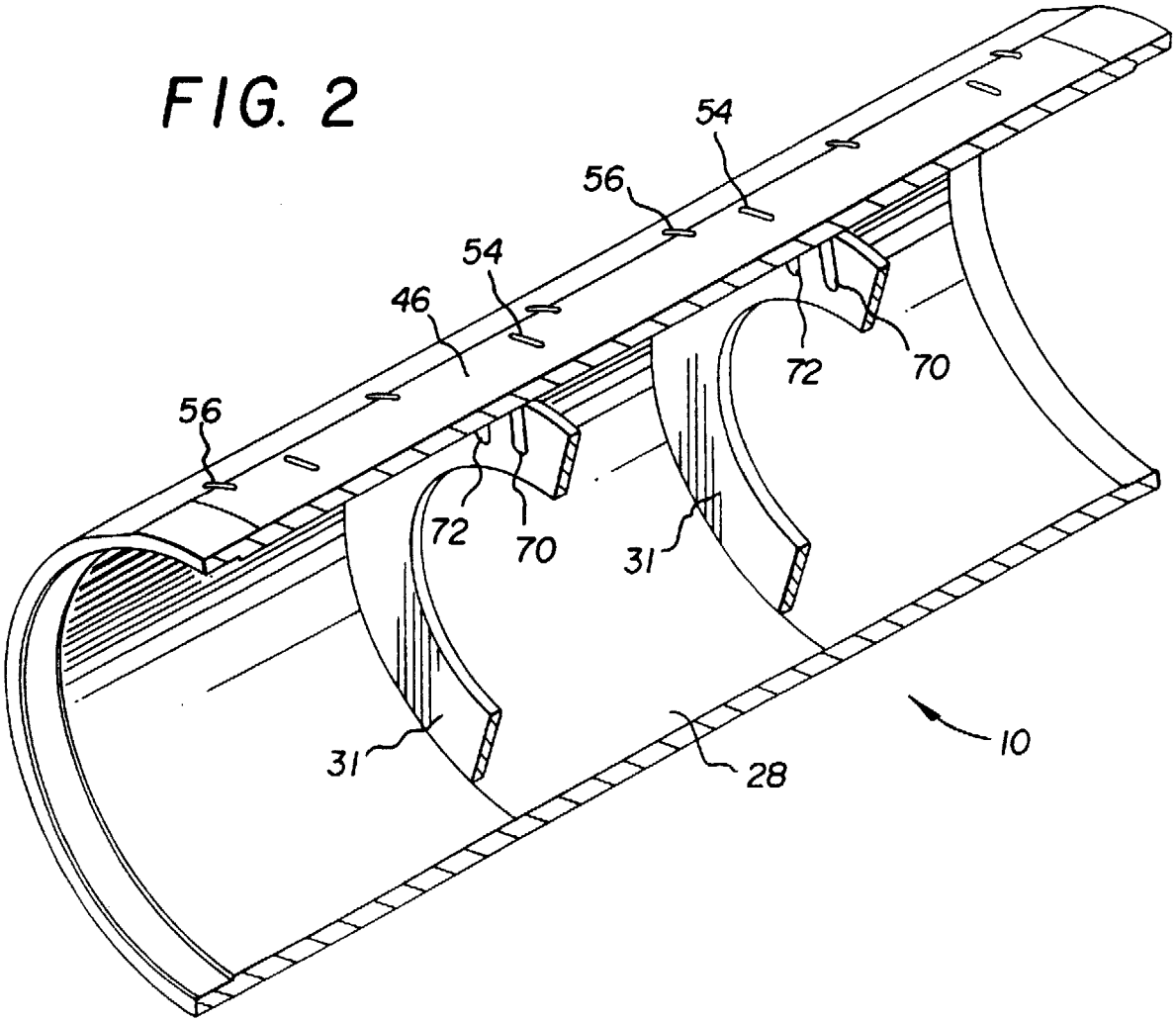
FIG. 2 is a perspective view, partially broken away, of the imaging drum of FIG. 1.
Figure 3:
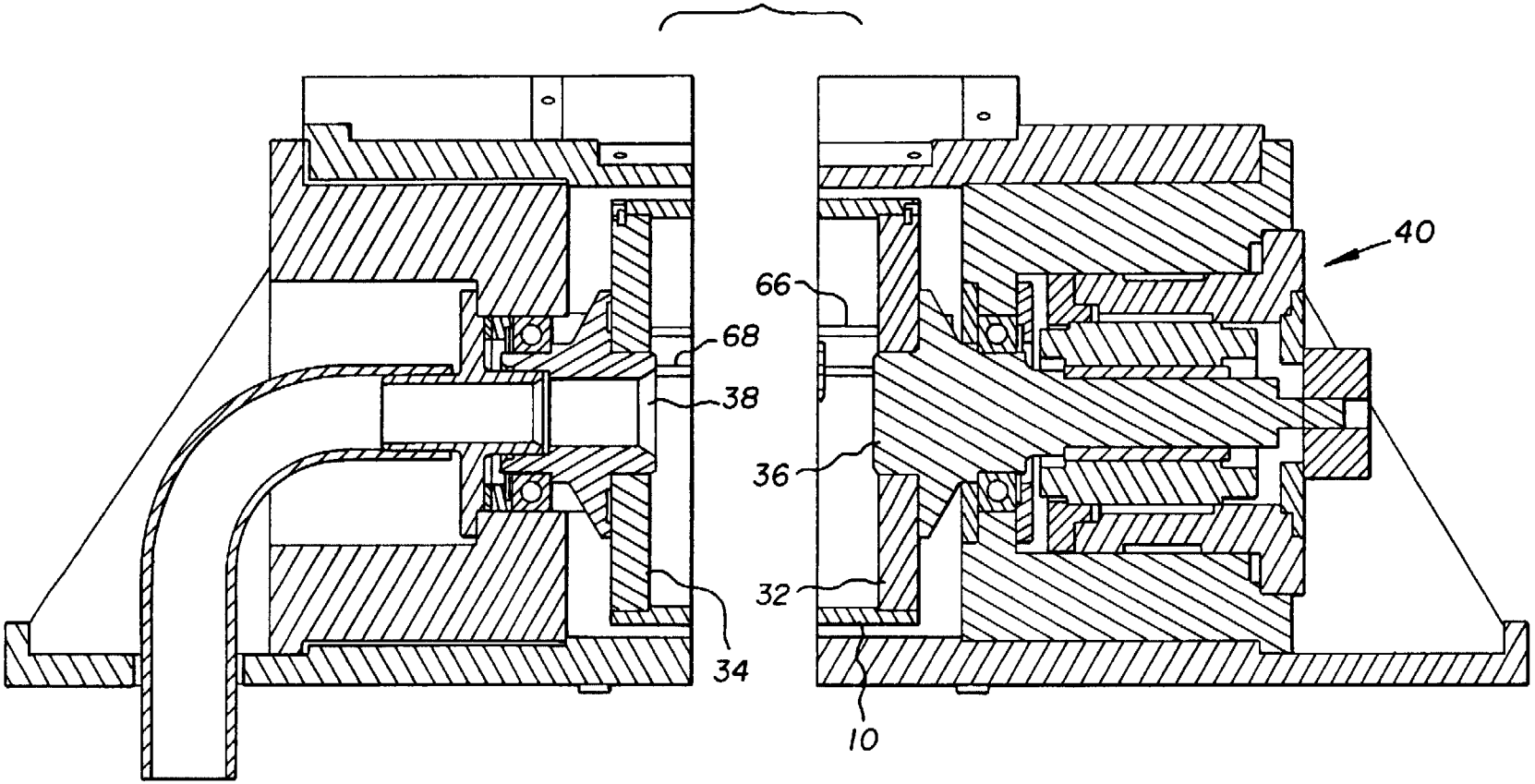
FIG. 3 is a cross section of the imaging drum of FIGS. 1 and 2, and of its drive assembly.
Figure 4:
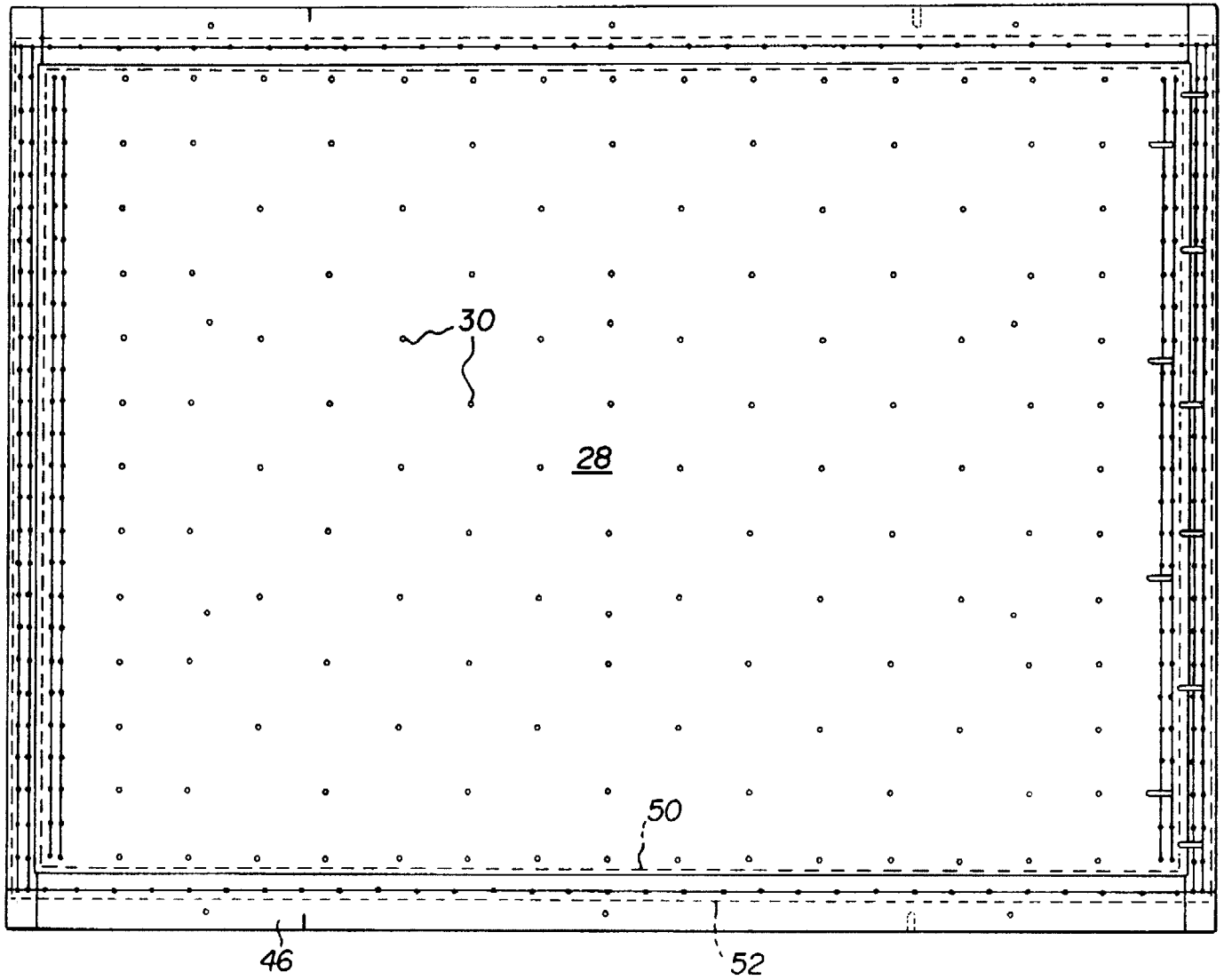
FIG. 4 is a view of the generated surface of the imaging drum.

Details of imaging drum 10 and its drive are illustrated in FIGS. 2–4. The drum is generally hollow and comprises a cylindrical shell 28 which may be manufactured from a length of extruded aluminum tubing and is provided with a plurality of drilled vacuum perforations 30 (FIG. 4). A pair of support rings 31 are spaced along the interior of the shell. The ends of the drum are closed by cylindrical plates 32 and 34, each of which is provided with centrally-disposed hubs 36 and 38, which extend outwardly therefrom through support bearings that are illustrated in FIG. 3 but not numbered in the drawing.

Hub member 36 is driven by a motor 40. The opposite hub 38 is provided with a central vacuum opening that is aligned with a vacuum pipe 44. Vacuum to the entire drum is controlled from a central source. Hub 38 allows vacuum to be accurately maintained while the drum is spinning.

The outer surface of the imaging drum is provided with an axially extending "flat" 46 (FIGS. 2 and 5). Referring to FIG. 4, the drum surface is illustrated unrolled. The area covered by a receiver sheet on the imaging drum surface is indicated by dotted lines 50. The area covered by a donor sheet on the imaging drum surface is indicated by dotted lines 52.

Referring back to FIG. 2, two series of axially-aligned slots 54 and 56 are provided for two rows of lift fins, to be described below. FIG. 5 shows a portion of drum shell, sectioned through one of slots 54. Each slot is provided with a steel ball bearing 58 which is captured in a pair of opposed recesses in the walls of the slots, and over which a lift fin 60 can be snapped; as shown in FIG. 6.

The lift fins pivot about their respective ball bearings 58, and have media bearing surfaces 62 and slotted arms 64. The distribution of mass of the lift fins relative to the pivot point causes the lift fin itself to rest in the "unextended" position of FIG. 6 due to centrifugal force when the drum spins. Here, media bearing surface 62 of the fin lies smooth with the drum surface.

Figure 7:
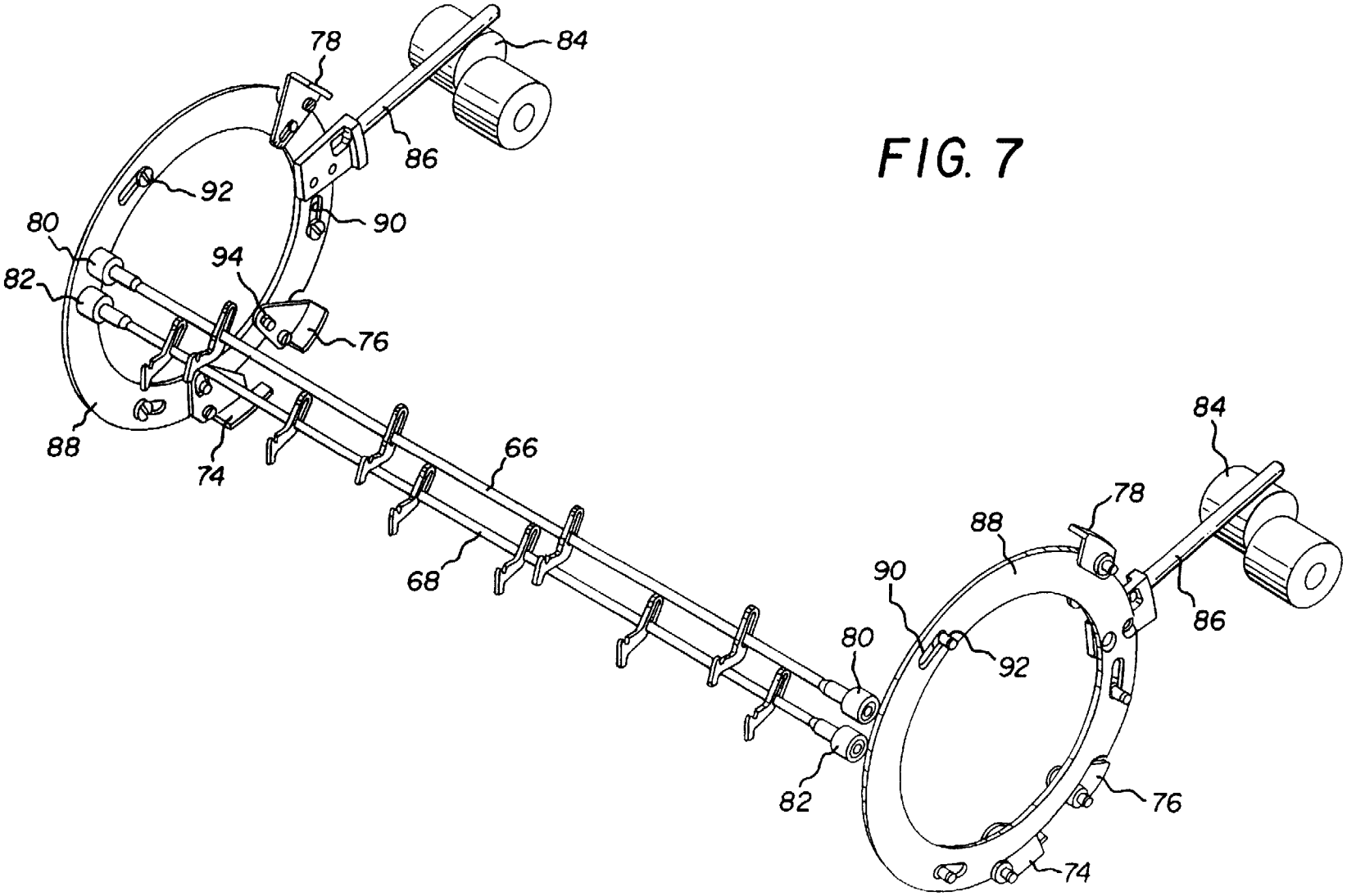
FIG. 7 shows control shafts for the lift fin of FIG. 6.
Figure 8:
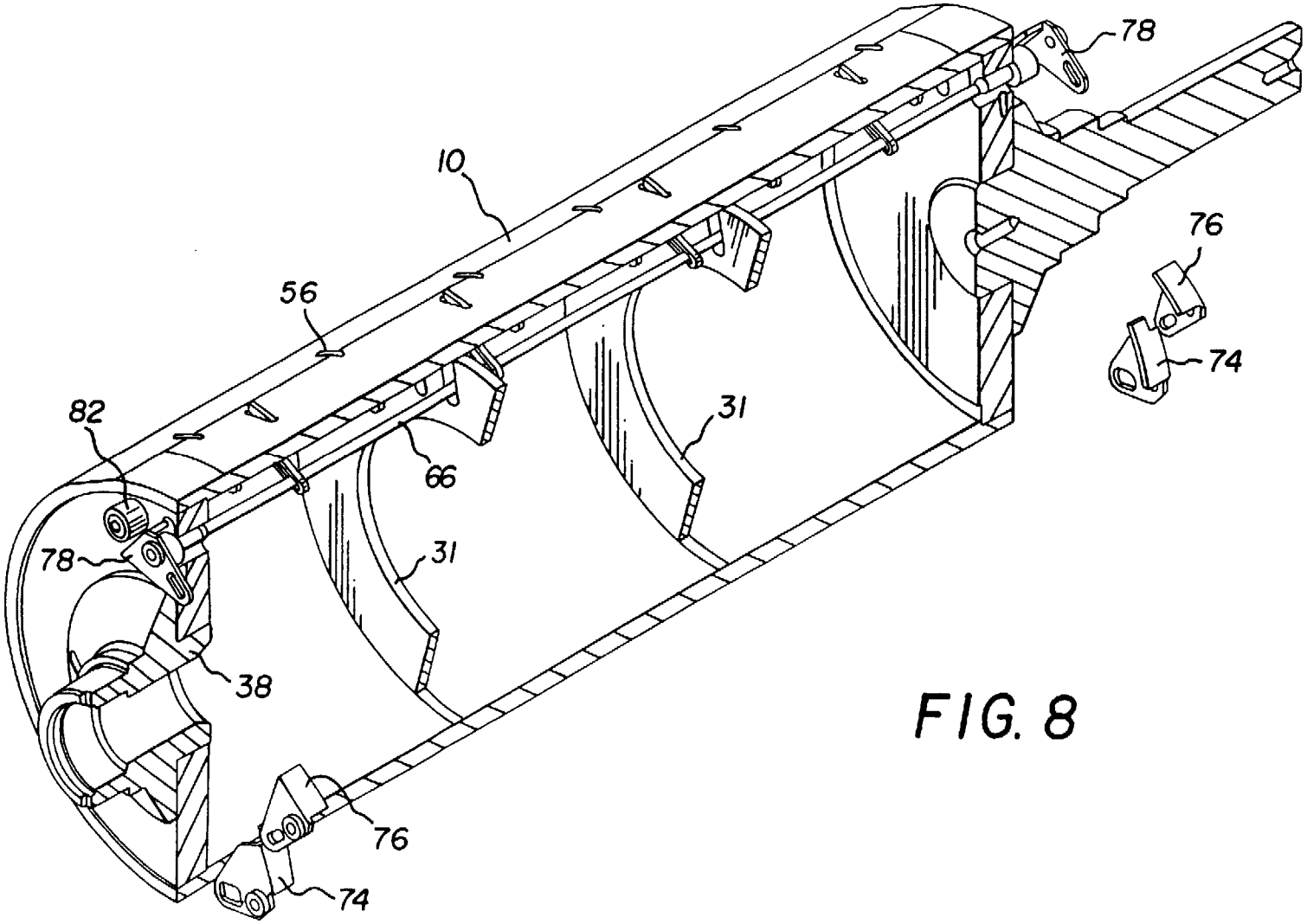
FIG. 8 shows the operation of the control shafts of FIG. 7.

Referring to FIG. 7, lift fin actuation is provided by a pair of internal control shafts 66 and 68 that run, through slots 70 and 72 in support rings 31 (FIG. 2) down the length of the imaging drum. The control shafts are steel. When one of the control shafts is in its "closed" position at the radially outward end of the slots, it contacts the inner surface of slotted arm 64 of the lift fins; as shown in FIG. 7, to lower the lift fin to its unextended position. The media bearing surface of the lift fin then lies even with the drum surface. When the control shaft is moved radially inwardly of the slot to an "active" position, it contacts the inner surface of slotted arm 64 of each lift fin in its row. This action causes the lift fin to raise, as illustrated in FIG. 8 with respect to lift fins in slots 54.

The control shaft position (and thus, lift fin actuation) is determined by means of cams 74, 76, and 78 and followers 80 and 82 at each end of the shafts. FIG. 8 shows the lift fins associated with slots 54 extended and the lift fins associated with slots 56 unextended.

Figure 9:
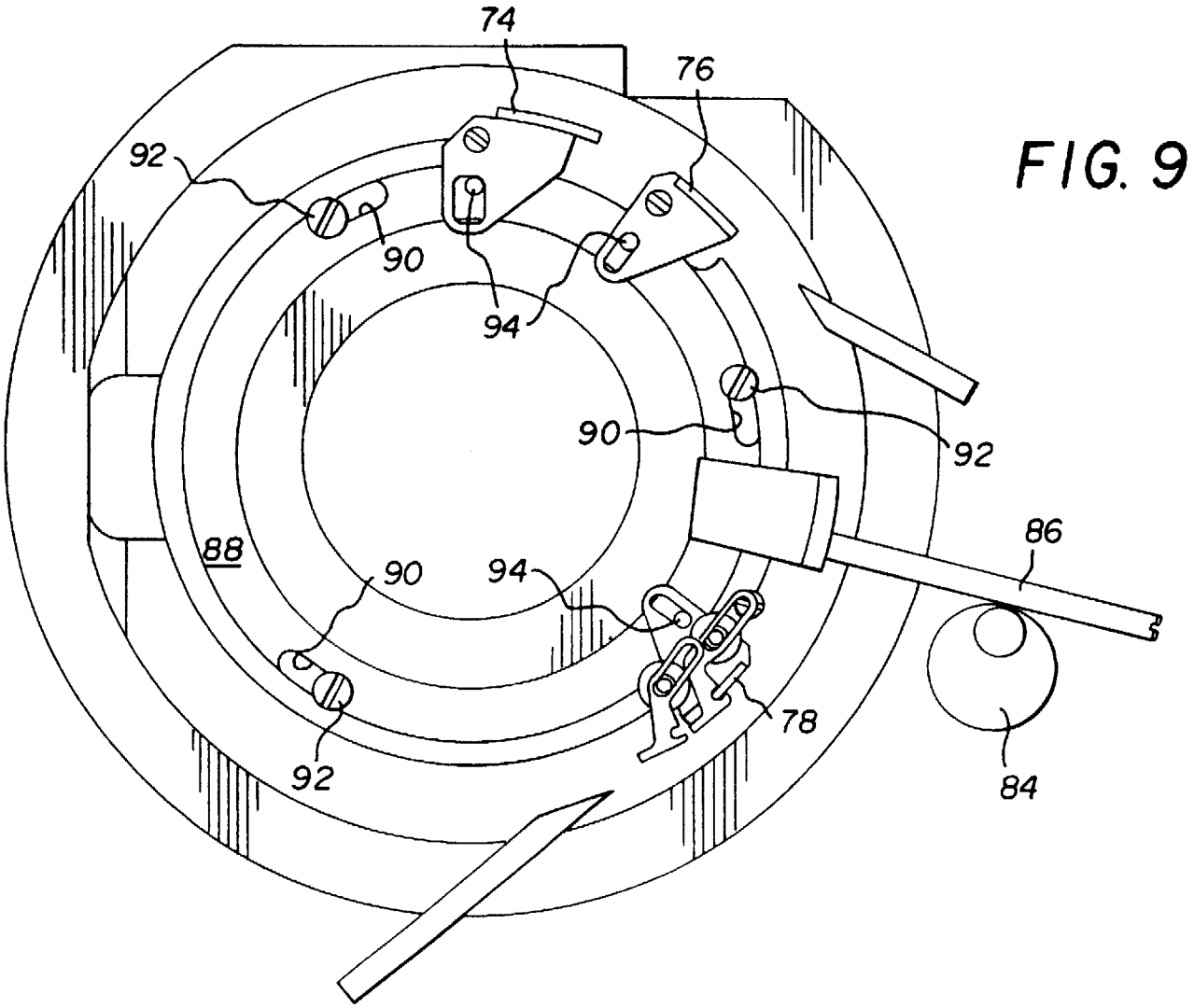
FIGS. 9 and 10 show the operation of lift fins of FIG. 6.
Figure 10:
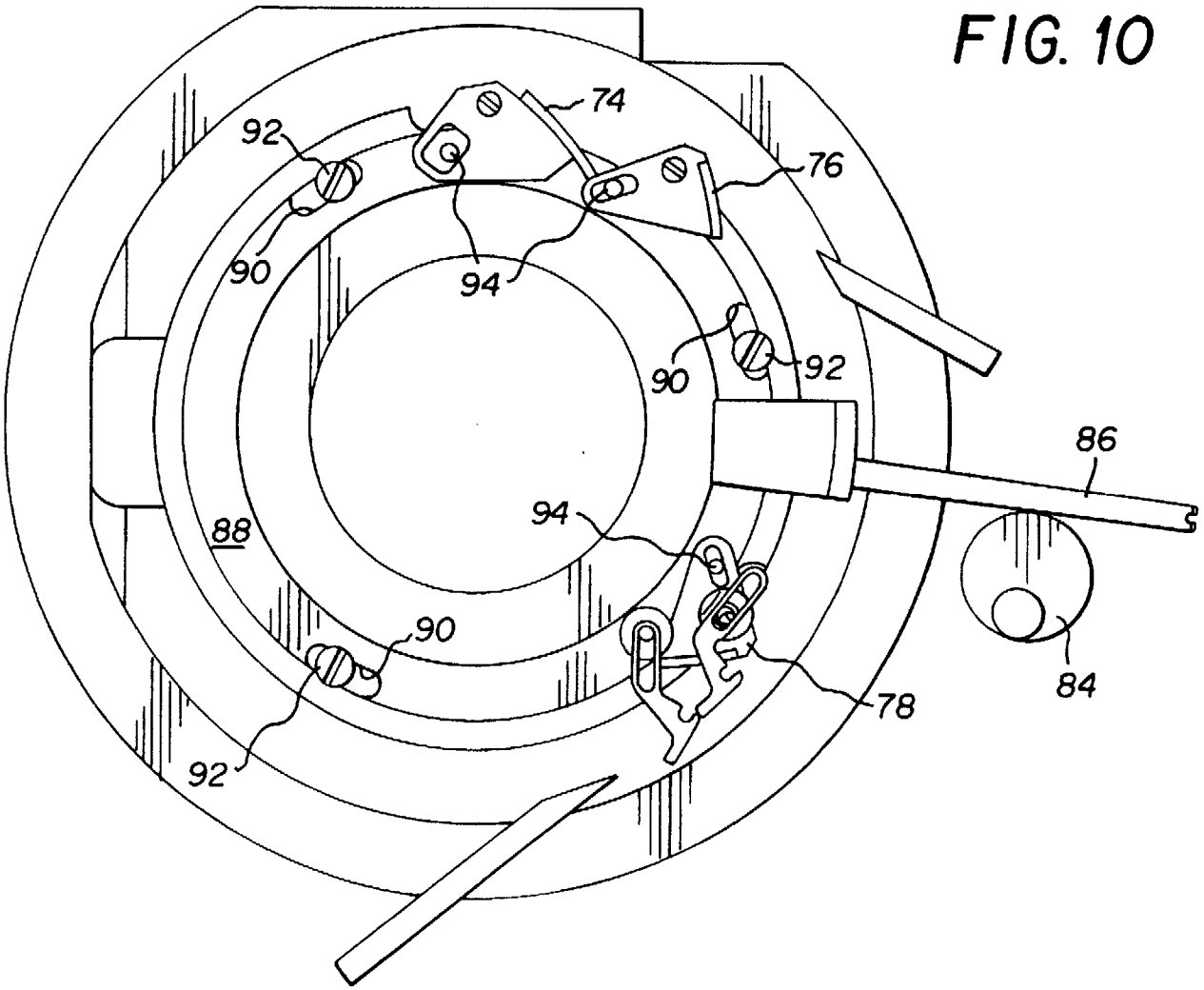

Actuation of the control shafts will be explained with reference to FIGS. 9 and 10. FIG. 9 illustrates the closed positions of the shafts and the associated unextended positions of the lift fins. Imaging drum 10 is shown in its position preparatory for unloading receiver. An eccentric cam 84 rotates by a DC motor, not shown, to move a ring actuator lever 86 from the FIG. 9 position to a position shown in FIG. 10. Movement of lever 86 rotates a ring 88 on slots 90 and ring retaining studs 92 Drive pins 94 on the ring are respectively associated with each cam 74, 76, and 78 to pivot all of the cams.

Depending on the position of imaging drum 10, one of cams 74, 76, and 78 may be positioned to move an associated shaft 66 and 68 from its closed to its active position. That shaft, when moved to its active position, will extend its associated lift fin. In FIG. 10, we show shaft 68 in its active position and its associated lift fin raised. This particular configuration is preparatory for unloading receiver sheets from imaging drum 10. Cam 78 is used to unload the receiver, cam 76 is used to unload donor, and cam 74 is used to load both donor and receiver. Again, all cams are activated simultaneously.

Figure 11A:
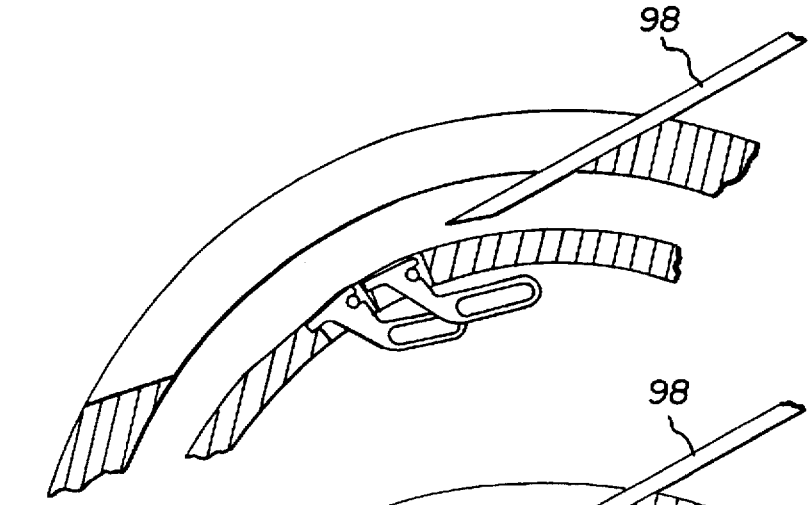
FIGS. 11*a* to 11*d* illustrate the receiver sheet loading process.
Figure 11B:
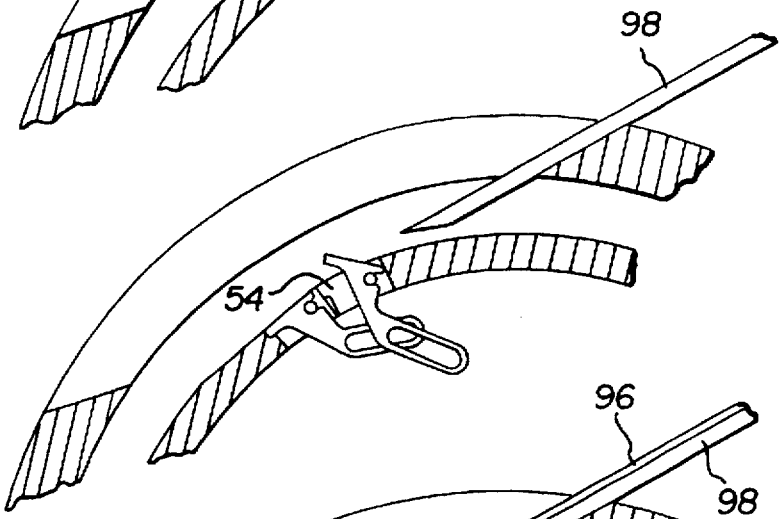
Figure 11C:
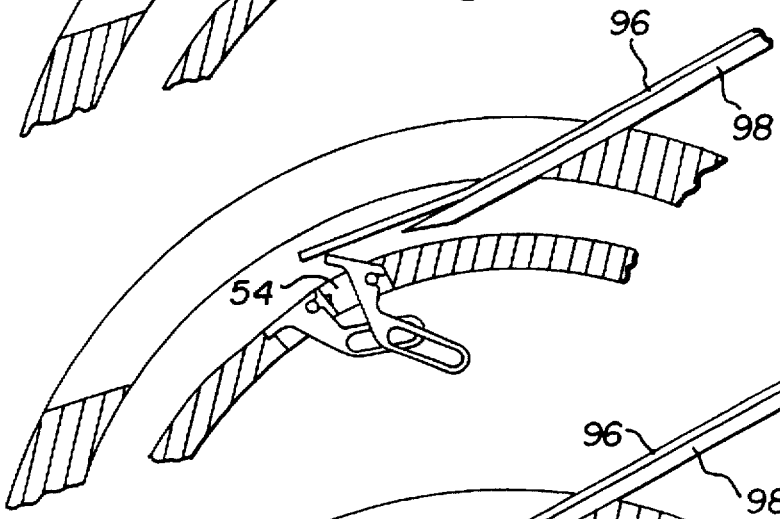

When it is actuated, a lift fin provides a ramp for the media. FIGS. 11A to 11D illustrate the receiver sheet loading process. In FIG. 11B, the lift fins associated with slots 54 are extended to allow the lead edge of a receiver sheet 96 to feed along a guide 98 to a position just past lift fin slot 54 (FIG. 11C) when the receiver sheet handling subsystem pushes the lead edge of the receiver sheet up to the writing drum. If the receiver sheet were not lifted from the surface of the drum for loading, vacuum force would grab the lead edge as soon as it neared the vacuum ports. This would prevent the receiver sheet from being loaded with its lead edge in the desired position. Thus, the lift fin provides a ramp that allows the lead edge to move forward, past these vacuum ports.

Figure 11D:
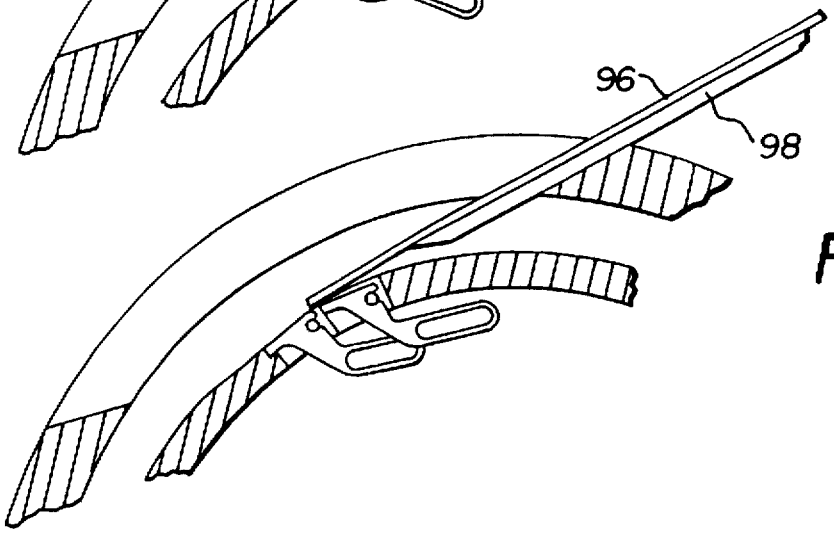

Once the lead edge of the receiver sheet is at the intended position, the lift fin recedes as shown in FIG. 11D. Vacuum force then grips the lead edge of the receiver sheet and effectively locks it into position against the drum. The drum now rotates to pull the rest of the receiver sheet forward and feed it onto the drum.

Figure 12A:
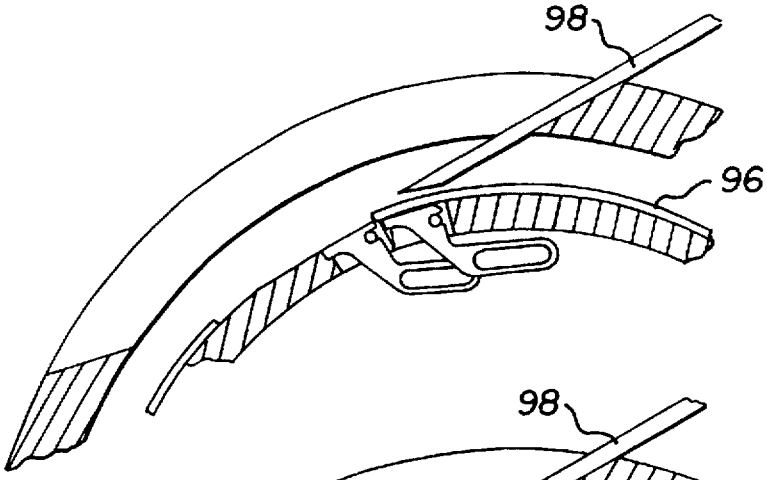
FIGS. 12*a* to 12*d* illustrate the donor sheet loading process.
Figure 12B:
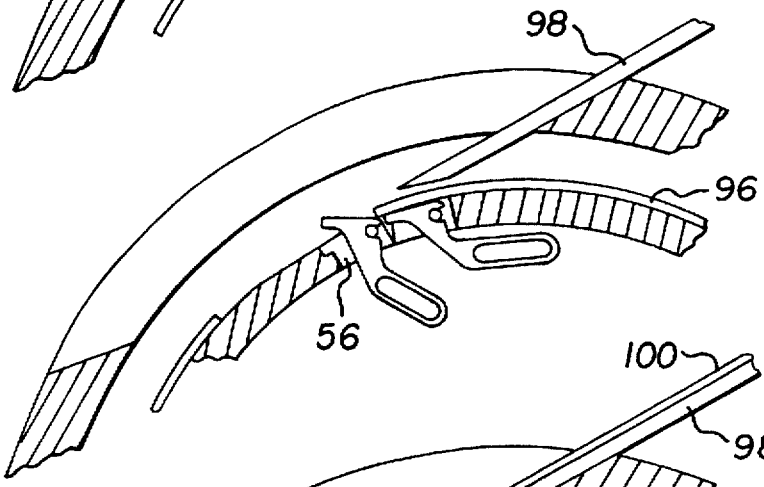
Figure 12C:
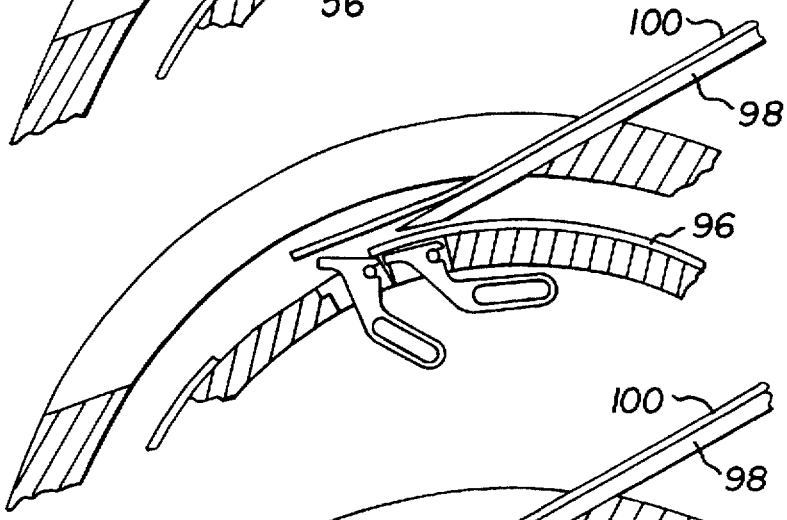
Figure 12D:
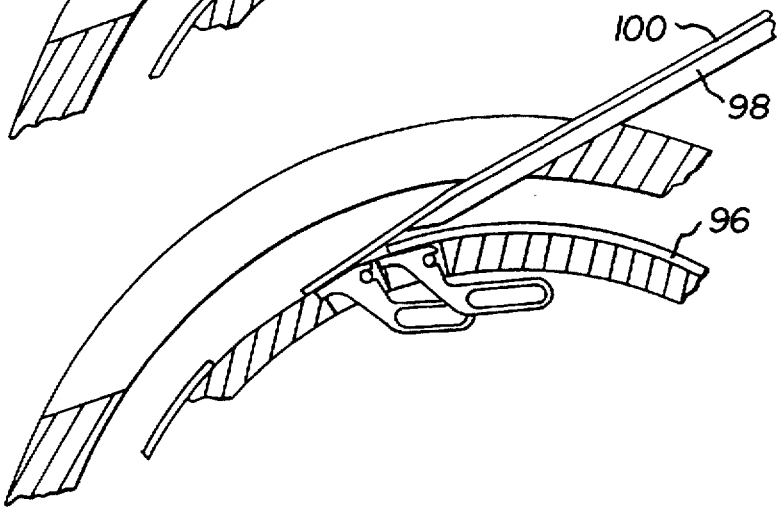

FIGS. 12A to 12D show a similar operation for loading donor sheets 100 onto the imaging drum. In FIG. 12B, the lift fins associated with slots 56 are extended to allow the donor sheet lead edge to feed a position just past the lift fin slot (FIG. 12C) when the donor sheet handling subsystem pushes the lead edge of the donor sheet up to the writing drum. Once the lead edge of the donor sheet is at the intended position, the lift fin recedes as shown in FIG. 12D. Vacuum force then grips the lead edge of the donor sheet and effectively locks it into position against the drum. The drum now rotates to pull the rest of the donor sheet forward and feed it onto the drum.

Figure 13:
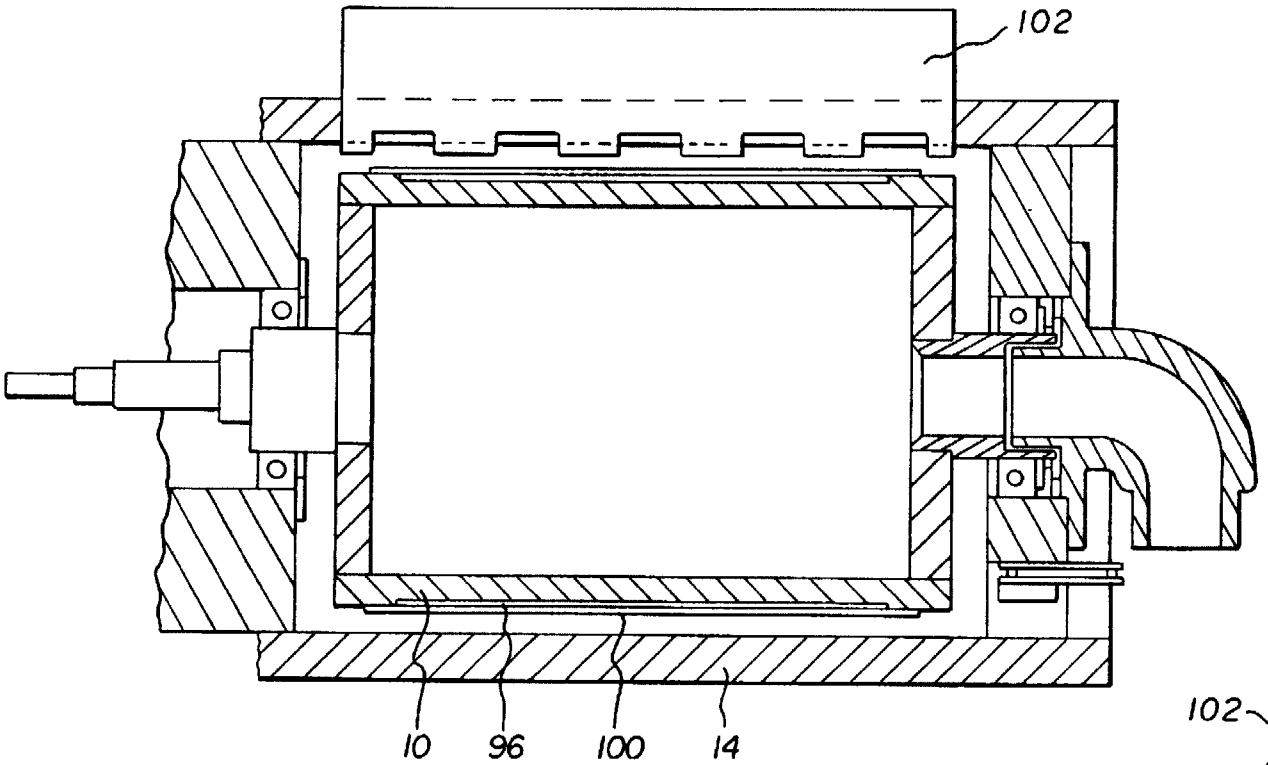
FIG. 13 is a sectional view of the drum, showing a skive for removing spent media.
Figure 14A:
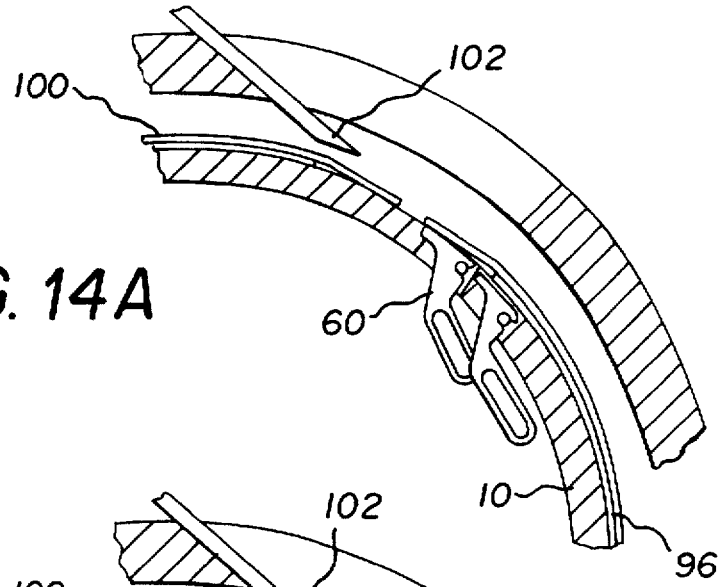
FIGS. 14A to 14C illustrate the sequence of operation of the skive of FIG. 13.
Figure 14B:
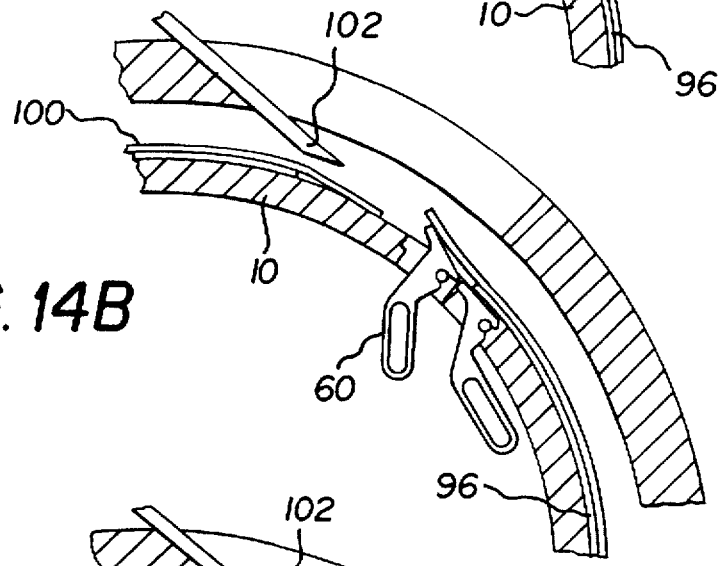
Figure 14C:
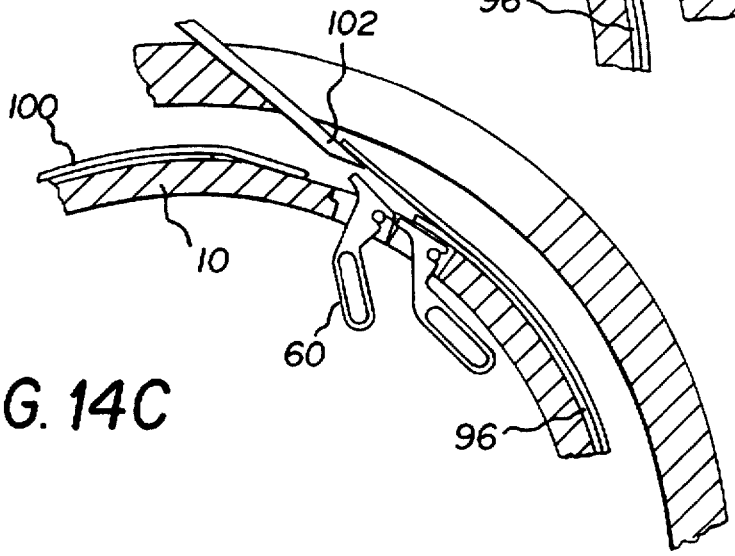

Referring to FIG. 13, an externally mounted fixed or articulated skive 102 is provided for receiver sheet unloading from imaging drum 10. FIGS. 14A to 14C show the sequence of steps for unloading donor sheets from the drum surface. For this activity, the lift fins raise the lead edge of the receiver sheet to the skive, which acts as a ramp for guiding the media to an output tray. Because the skive is slotted, the lift fins pass through the skive. The donor sheet, however, moves onto the surface of the skive.

Figure 15:
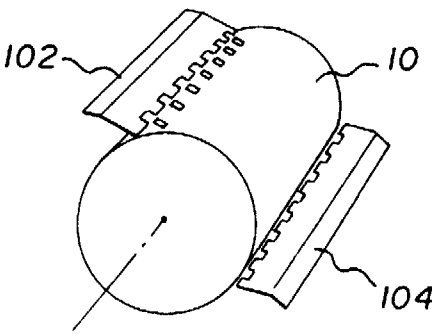
FIG. 15 is a perspective view of the drum, showing two skives for removing spent media.
Figure 16C:
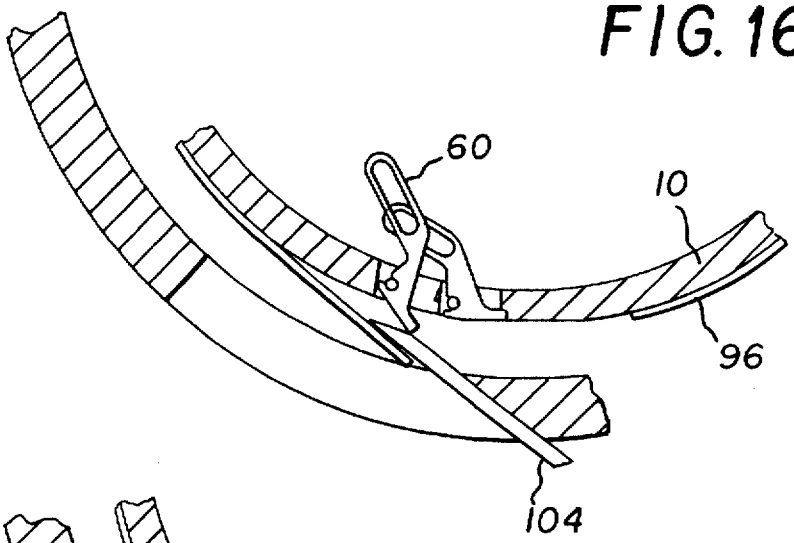
FIGS. 16A to 16C illustrate the sequence of operation of the second skive of FIG. 15.
Figure 16B:
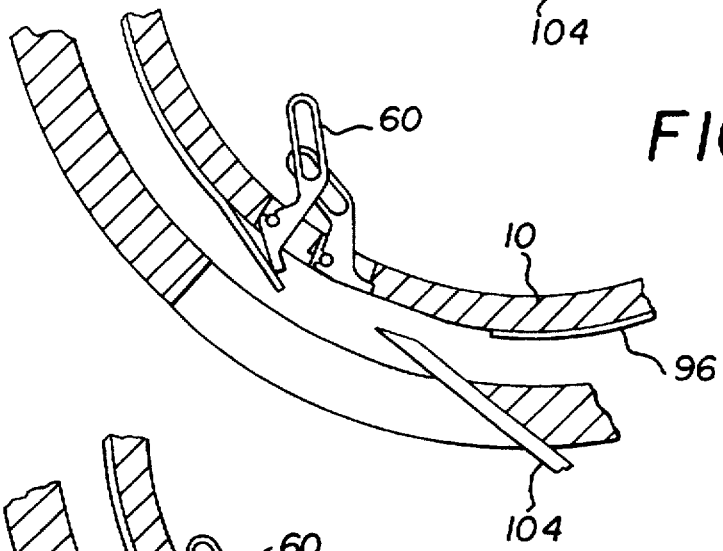
Figure 16A:
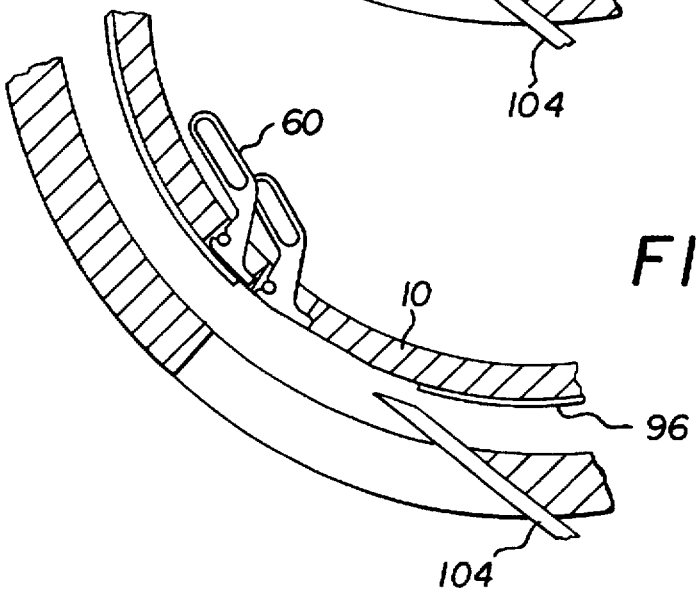

As shown in FIG. 15, a second skive 104 is mounted near the bottom of drum 10 for removing spent receiver sheets in a manner similar to the operation of skive 102. FIGS. 16A to 16C show the sequence of steps for unloading receiver sheets from the drum surface.

The invention has been described in detail with particular reference to preferred embodiments thereof, but it will be understood that variations and modifications can be effected within the spirit and scope of the invention.

What is claimed is:

1. Apparatus for selectively loading sheets on a hollow imaging drum mounted for rotation about an axis and arranged to mount a receiver sheet and a donor sheet in superposed relationship thereon; said apparatus comprising:

means for providing a vacuum to the interior of the imaging drum;

openings through the surface of the drum for communicating the vacuum from the interior to the exterior surface of the drum;

means for advancing a leading edge of a receiver sheet into alignment with a predetermined position on the drum surface;

means for holding the leading edge of the receiver sheet radially off of the drum surface until aligned with the predetermined position;

means for rotating the drum to thereby draw the receiver sheet into contact with the drum surface;

means for advancing a leading edge of a donor sheet into alignment with a second predetermined position on the drum surface not covered by the receiver sheet;

means for holding the leading edge of the donor sheet radially off of the drum surface until aligned with the second predetermined position; and means for rotating the drum to thereby draw the donor sheet into contact with the drum surface in superposed relation with the receiver sheet adhered thereto.

2. Apparatus as set forth in claim 1 wherein the means for holding the leading edge of the receiver sheet radially off of the drum surface until aligned with the predetermined position is adapted to thereupon lower the leading edge radially onto the drum surface.

3. Apparatus as set forth in claim 1 wherein the means for holding the leading edge of the donor sheet radially off of the drum surface until aligned with the second predetermined position is adapted to thereupon lower the leading edge of the donor sheet radially onto the drum surface.

4. Apparatus as set forth in claim 1 wherein the drum has:

a plurality of rows of vacuum ports aligned with edges of loaded receiver and donor sheets, respectively; and a single vacuum source exposed uniformly to all ports simultaneously.

5. Apparatus as set forth in claim 1 wherein said means for holding the leading edge of the receiver and donor sheets includes:

a plurality of lift fins; and an actuation rod associated with said lift fins, the rod being mounted for movement between a closed position holding associated lift fins unextended from the drum surface and an actuated position raising the associated lift fins to positions extended from the drum surface.

6. Apparatus as set forth in claim 5 further comprising supports in the drum to provide tangential rod support, whereby acceleration and deceleration of the drum do not tangential affect the position of the rods in the drum.

7. Apparatus as set forth in claim 6 wherein the drum has an axially extending surface flat, and further comprising an internal support for the drum to inhibit the flat from causing out-of-round drum condition due to centrifugal forces thereon.

8. Apparatus as set forth in claim 7 wherein the internal support for the drum and the support for the rods are same member.

9. Apparatus as set forth in claim 5 wherein the lift fins are adapted to pivot about a point such that mass distribution of the lift fins about the point is such that the lift fins are balanced toward their extended positions by centrifugal force.

10. Apparatus for selectively unloading superposed sheets from a hollow imaging drum mounted for rotation about an axis; said apparatus comprising:

means for providing a vacuum to the interior of the imaging drum;

openings through the surface of the drum for communicating the vacuum from the interior to the exterior surface of the drum;

means for raising a leading edge of a donor sheet from the drum surface;

means for skiving the raised leading edge of the donor sheet radially off of the drum surface;

means for rotating the drum to thereby withdraw the donor sheet from the drum surface;

means for raising a leading edge of a receiver sheet from the drum surface;

means for skiving the raised leading edge of the receiver sheet radially off of the drum surface; and means for rotating the drum to thereby withdraw the donor sheet from the drum surface.

11. A method for selectively loading sheets on a hollow imaging drum mounted for rotation about an axis and arranged to mount a receiver sheet and a donor sheet in superposed relationship thereon; said method comprising:

providing a vacuum to the interior of the imaging drum;

communicating the vacuum from the interior to the exterior surface of the drum;

advancing a leading edge of a receiver sheet into alignment with a predetermined position on the drum surface;

holding the leading edge of the receiver sheet radially off of the drum surface until aligned with the predetermined position;

rotating the drum to thereby draw the receiver sheet into contact with the drum surface;

advancing a leading edge of a donor sheet into alignment with a second predetermined position on the drum surface not covered by the receiver sheet;

holding the leading edge of the donor sheet radially off of the drum surface until aligned with the second predetermined position; and rotating the drum to thereby draw the donor sheet into contact with the drum surface in superposed relation with the receiver sheet adhered thereto.

12. A method as set forth in claim 11 wherein the leading edge of the receiver sheet is held radially off of the drum surface until aligned with the predetermined position and is thereupon lowered radially onto the drum surface.

13. A method as set forth in claim 11 wherein the leading edge of the donor sheet is held radially off of the drum surface until aligned with the second predetermined position is thereupon lowered radially onto the drum surface.

14. A method for selectively unloading superposed sheets from a hollow imaging drum mounted for rotation about an axis; said method comprising:

providing a vacuum to the interior of the imaging drum;

communicating the vacuum from the interior to the exterior surface of the drum;

raising a leading edge of a donor sheet from the drum surface;

skiving the raised leading edge of the donor sheet radially off of the drum surface;

rotating the drum to thereby withdraw the donor sheet from the drum surface;

raising a leading edge of a receiver sheet from the drum surface;

skiving the raised leading edge of the receiver sheet radially off of the drum surface; and rotating the drum to thereby withdraw the donor sheet from the drum surface.

* * * * *